US009958824B2

(12) United States Patent
Takeuchi

(10) Patent No.: US 9,958,824 B2
(45) Date of Patent: May 1, 2018

(54) IMAGE FORMING APPARATUS SUITED FOR MANAGEMENT OF WASTE TONER

(71) Applicant: KYOCERA Document Solutions Inc., Osaka (JP)

(72) Inventor: Naoki Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/356,573

(22) Filed: Nov. 19, 2016

(65) Prior Publication Data

US 2017/0146945 A1 May 25, 2017

(30) Foreign Application Priority Data

Nov. 19, 2015 (JP) ..... 2015-226599

(51) Int. Cl.
*G03G 21/10* (2006.01)
*G03G 21/12* (2006.01)
(Continued)

(52) U.S. Cl.
CPC ..... *G03G 21/10* (2013.01); *G03G 21/12* (2013.01); *G03G 15/086* (2013.01); *G03G 15/0844* (2013.01); *G03G 15/0856* (2013.01); *G03G 15/0858* (2013.01); *G03G 15/0862* (2013.01); *G03G 15/0863* (2013.01);
(Continued)

(58) Field of Classification Search
CPC ..... G03G 15/0844; G03G 15/0856; G03G 15/0858; G03G 15/086; G03G 15/0862; G03G 15/0863; G03G 15/5012; G03G 15/5016; G03G 15/502; G03G 15/5041; G03G 15/553; G03G 15/556; G03G 21/10; G03G 21/12
See application file for complete search history.

(56) References Cited

U.S. PATENT DOCUMENTS

2012/0163837 A1* 6/2012 Tomita ..... G03G 21/105 399/13
2013/0028625 A1* 1/2013 Ando ..... G03G 15/0189 399/72

FOREIGN PATENT DOCUMENTS

JP H08-076664 A 3/1996
JP 2004-184820 A 7/2004
JP 2009-069764 A 4/2009

* cited by examiner

*Primary Examiner* — Joseph S Wong

(74) *Attorney, Agent, or Firm* — Hawaii Patent Services; Nathaniel K. Fedde; Kenton N. Fedde

(57) ABSTRACT

Provided is an image forming apparatus that reduces replacement frequency for waste toner container, and efficiently performs waste toner accommodation with a waste toner container. The image forming apparatus includes a toner detection sensor detecting a quantity of a toner in a toner container; a waste toner detection sensor detecting an accommodation quantity of a waste toner removed from a photosensitive medium and accommodated in a waste toner container; a waste toner container full-state forecasting part that, upon toner detection sensor detecting empty state of toner container, forecasts whether waste toner container is filled up with waste toner before toner container newly loaded is emptied, on detection result by waste toner detection sensor; and a system control part that, upon waste toner container full-state forecasting part forecasting waste toner container being filled up, notifies a replacement message urging replacement of waste toner container to a panel part.

9 Claims, 5 Drawing Sheets

(51) Int. Cl.
*G03G 15/00* (2006.01)
*G03G 15/08* (2006.01)

(52) U.S. Cl.
CPC ..... *G03G 15/502* (2013.01); *G03G 15/5012* (2013.01); *G03G 15/5016* (2013.01); *G03G 15/5041* (2013.01); *G03G 15/553* (2013.01); *G03G 15/556* (2013.01)

IMAGE FORMING APPARATUS SUITED FOR MANAGEMENT OF WASTE TONER

INCORPORATION BY REFERENCE

This application is based on and claims the benefit of priority from Japanese Patent Application No. 2015-226599 filed on Nov. 19, 2015, the contents of which are hereby incorporated by reference.

BACKGROUND

The present disclosure relates to an image forming apparatus waste suited for management of waste toner.

With an image forming apparatus that is a printer, a multi-function printer, or an MFP (Multifunction Peripheral), such as a multifunctional machine, when an image is to be printed on a paper sheet, a latent image that is formed on, for example, a photosensitive drum, which is a photosensitive medium, is visualized with a developer (toner), and a toner image therefor is transferred to the paper sheet.

On the surface of the photosensitive drum, the toner that has not been transferred to the paper sheet may be left. Since such remaining toner will introduce deterioration of the image quality at the next time of transfer, it is appropriately removed from the photosensitive drum with a blade, or the like. The waste toner that has been removed is conveyed to a waste toner box through a specific path, and stored.

By the way, if the waste toner box is filled up with the waste toner that has been stored, the waste toner in the waste toner box may be scattered. Therefore, when or before the waste toner box has been filled up, it is required to urge the user to replace the waste toner box.

As the typical technique for urging replacement of a waste toner box, there is available a system that can monitor the toner environment, being loaded in an image forming apparatus. This system in the image forming apparatus has a first detection means that detects the quantity of the toner in the toner cartridge, using least a first threshold as a criterion, a second detection means that detects whether the waste toner box is loaded in or removed from the image forming apparatus, a reporting means that issues a first alarm informing the operator of the time when the waste toner box is to be replaced having come, and a control means that drive-controls the reporting means such that it issues a first alarm, if the first detection means detects that the toner quantity has been reduced to below a first threshold, and terminates the issue of the first alarm, if the second detection means detects that the waste toner box has been removed and loaded.

SUMMARY

An image forming apparatus of the present disclosure includes a toner detection sensor that detects a quantity of a toner in a toner container; a waste toner detection sensor that detects an accommodation quantity of a waste toner that has been accommodated in a waste toner container, the waste toner having be removed from a photosensitive medium; a waste toner container full-state forecasting part that, upon the toner detection sensor detecting an empty state of the toner container, forecasts whether or not the waste toner container will be filled up with the waste toner before the toner container that has been newly loaded is emptied, based on the result of detection by the waste toner detection sensor; and a system control part that, upon the waste toner container full-state forecasting part forecasting that the waste toner container will be filled up, notifies a replacement message that urges replacement of the waste toner container to a panel part.

DETAILED DESCRIPTION

Hereinbelow, an embodiment of an image forming apparatus of the present disclosure will be explained with reference to FIG. 1 to FIG. 4A and FIG. 4B. As an example of an image forming apparatus in the following explanation, the image forming apparatus is assumed to be an MFP (Multifunction Peripheral), which is a multifunctional peripheral that is loaded with, for example, a printing function, a copying function, a facsimiling function, a data transmitting/receiving function through a network, and the like.

Figure 1:
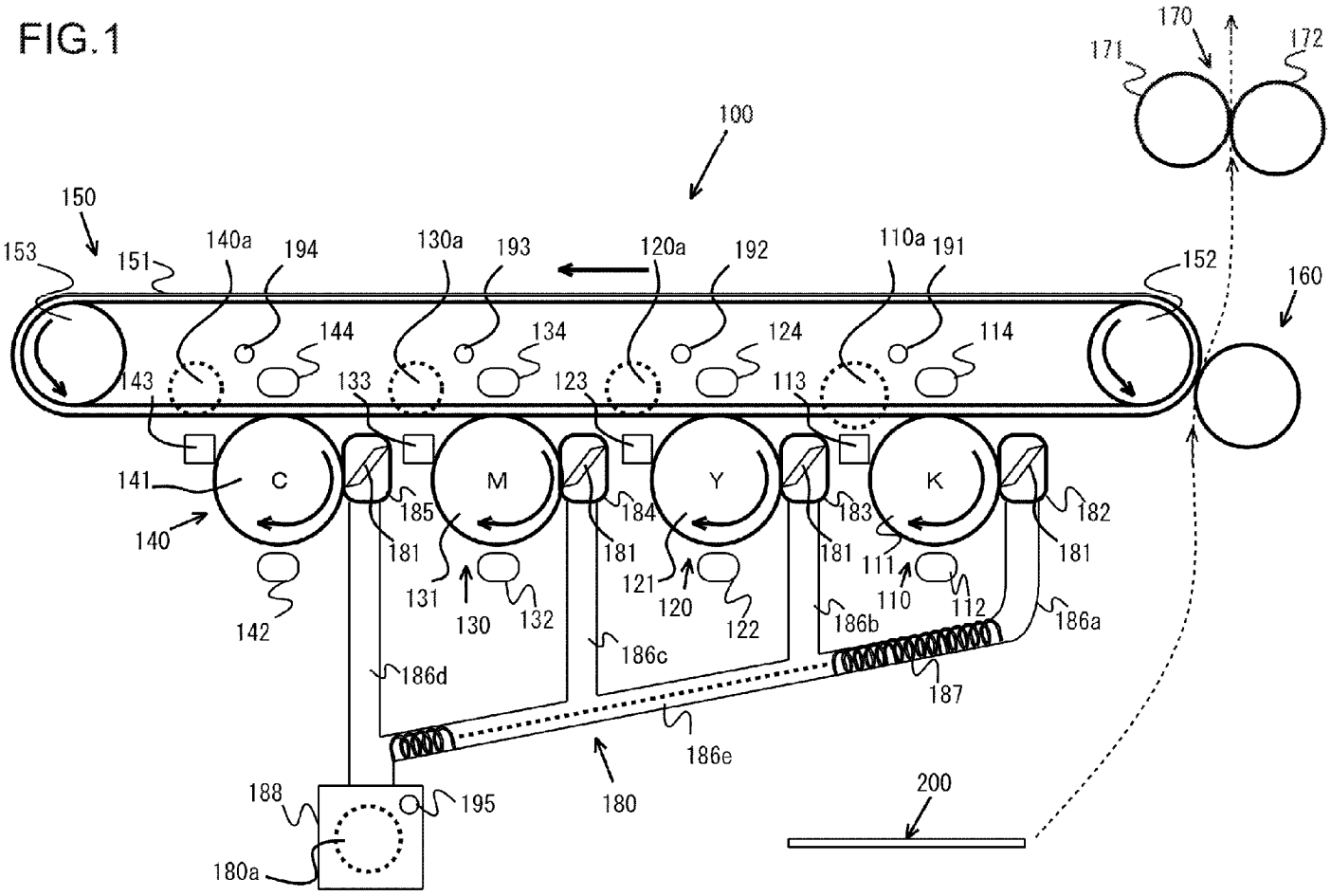
FIG. 1 shows the outline of the critical part in the situation where the image forming apparatus of the present disclosure has been applied to an MFP.

First, with reference to FIG. 1, the outline of a critical portion of an MFP 100, which is an image forming apparatus, will be explained. The MFP 100 shown in FIG. 1 is assumed to be of tandem type, for example. The MFP 100 includes image forming parts 110 to 140, an intermediate transfer part 150, a secondary transfer part 160, a fixing part 170, and a waste toner collecting part 180. The image forming parts 110 to 140, the intermediate transfer part 150, the secondary transfer part 160, and the fixing part 170 constitute a later-described printer part 202.

In addition, the reference numeral 110*a* denotes a toner container accommodating a black (K) toner (hereinbelow, to be called a K toner container). In addition, the reference numeral 120*a* denotes a toner container accommodating a yellow (Y) toner (hereinbelow, to be called a Y toner container). In addition, the reference numeral 130*a* denotes a toner container accommodating a magenta (M) toner (hereinbelow, to be called an M toner container). In addition, the reference numeral 140*a* denotes a toner container accommodating a cyan (C) toner (hereinbelow, to be called a C toner container). These toner containers are detachably mounted to the MFP 100. In addition, these toner containers are disposed in the vicinity of later-described developing devices 113 to 141.

In addition, the reference numerals 191 to 194 denote toner detection sensors that detect the quantity of the toner in the K toner container 110*a*, the Y toner container 120*a*, the M toner container 130*a*, and the C toner container 140*a*, respectively. In addition, the reference numeral 195 denotes a waste toner detection sensor that detects the accommodation quantity of a waste toner that has been accommodated in a later-described waste toner container 180*a*. These toner detection sensors 191 to 194 and the waste toner detection sensor 195 are constituted by a weight sensor, a light-transmission type sensor, or the like.

The image forming parts 110 to 140 form toner images that are different from one another in color. The image forming part 110 is for black (K); the image forming part 120 is for yellow (Y); the image forming part 130 is for magenta (M); and the image forming part 140 is for cyan (C).

The image forming part 110 has a photosensitive drum 111 that is a photosensitive medium carrying a toner image, and an electrifying device 112 that electrifies the surface of the photosensitive drum 111. The image forming part 120 has a photosensitive drum 121 that is a photosensitive medium carrying a toner image, and an electrifying device 122 that electrifies the surface of the photosensitive drum 121. The image forming part 130 has a photosensitive drum 131 that is a photosensitive medium carrying a toner image, and an electrifying device 132 that electrifies the surface of the photosensitive drum 131. The image forming part 140 has a photosensitive drum 141 that is a photosensitive medium carrying a toner image, and an electrifying device 142 that electrifies the surface of the photosensitive drum 141. On the surfaces of the photosensitive drums 111 to 141 that are electrified, an electrostatic latent image is written in by optical scanning with an exposure device.

In addition, the image forming part 110 has a developing device 113 that develops the electrostatic latent image on the photosensitive drum 111 with a toner, and a primary transfer device 114 that transfers the toner image on the photosensitive drum 111 that is being turned. The image forming part 120 has a developing device 123 that develops the electrostatic latent image on the photosensitive drum 121 with a toner, and a primary transfer device 124 that transfers the toner image on the photosensitive drum 121 that is being turned. The image forming part 130 has a developing device 133 that develops the electrostatic latent image on the photosensitive drum 131 with a toner, and a primary transfer device 134 that transfers the toner image on the photosensitive drum 131 that is being turned. The image forming part 140 has a developing device 143 that develops the electrostatic latent image on the photosensitive drum 141 with a toner, and a primary transfer device 144 that transfers the toner image on the photosensitive drum 141 that is being turned.

The intermediate transfer part 150 has a intermediate transfer belt 151 that is stretched over between a driving roller 152 and a driven roller 153, and is run in a direction of an arrow (a counterclockwise direction). The above-mentioned primary transfer devices 114 to 144 transfer the toner images on the photosensitive drums 111 to 141 to the intermediate transfer belt 151, respectively.

The secondary transfer part 160 transfers the toner images that have been transferred to the intermediate transfer belt 151 to a paper sheet 200. The fixing part 170 has a heating roller 171 and a pressing roller 172. The heating roller 171 gives heat at a temperature of approx. 200° C. or higher. The heating roller 171 and the pressing roller 172 weld the toner images to the paper sheet 200 in the course in which they feed out the sheet paper 200 towards the discharge part side (in a direction of an arrow shown in FIG. 1), while putting the sheet paper 200 between them.

The waste toner collecting part 180 has cleaning parts 182 to 185 that include a blade 181 or the like, waste toner paths 186*a* to 186*e*, and a waste toner accommodating box 188. The blades 181 in the cleaning parts 182 to 185 remove the toner (waste toner) that has been left on the surfaces of the photosensitive drums 111 to 141 after the toner images having been transferred on the paper sheet 200, respectively.

The waste toner paths 186*a* to 186*d* are connected to the cleaning parts 182 to 185, respectively, leading the toner that has been removed by the respective blades 181, downwards. The waste toner path 186*e* includes a spiral screw 187. The waste toner path 186*e* leads the toners that have been led by the waste toner paths 186*a* to 186*d* towards the waste toner accommodating box 188 by means of the spiral screw 187.

To the waste toner accommodating box 188, a waste toner container 180*a* is detachably mounted. Then, the waste toner that has been led by the spiral screw 187 is accommodated in the waste toner container 180*a*. The accommodation quantity of the waste toner that has been accommodated in the waste toner container 180*a* is detected by the above-mentioned waste toner detection sensor 195. In the waste toner accommodating box 188, the K toner container 110*a*, the Y toner container 120*a*, the M toner container 130*a*, and/or the C toner container 140*a* that have been emptied can be loaded as the waste toner container 180*a*. In other words, when the waste toner container 180*a* has been filled up with the waste toner that has been accommodated, and is replaced, the toner container that has been emptied is reused, being loaded in the waste toner accommodating box 188.

Figure 2:
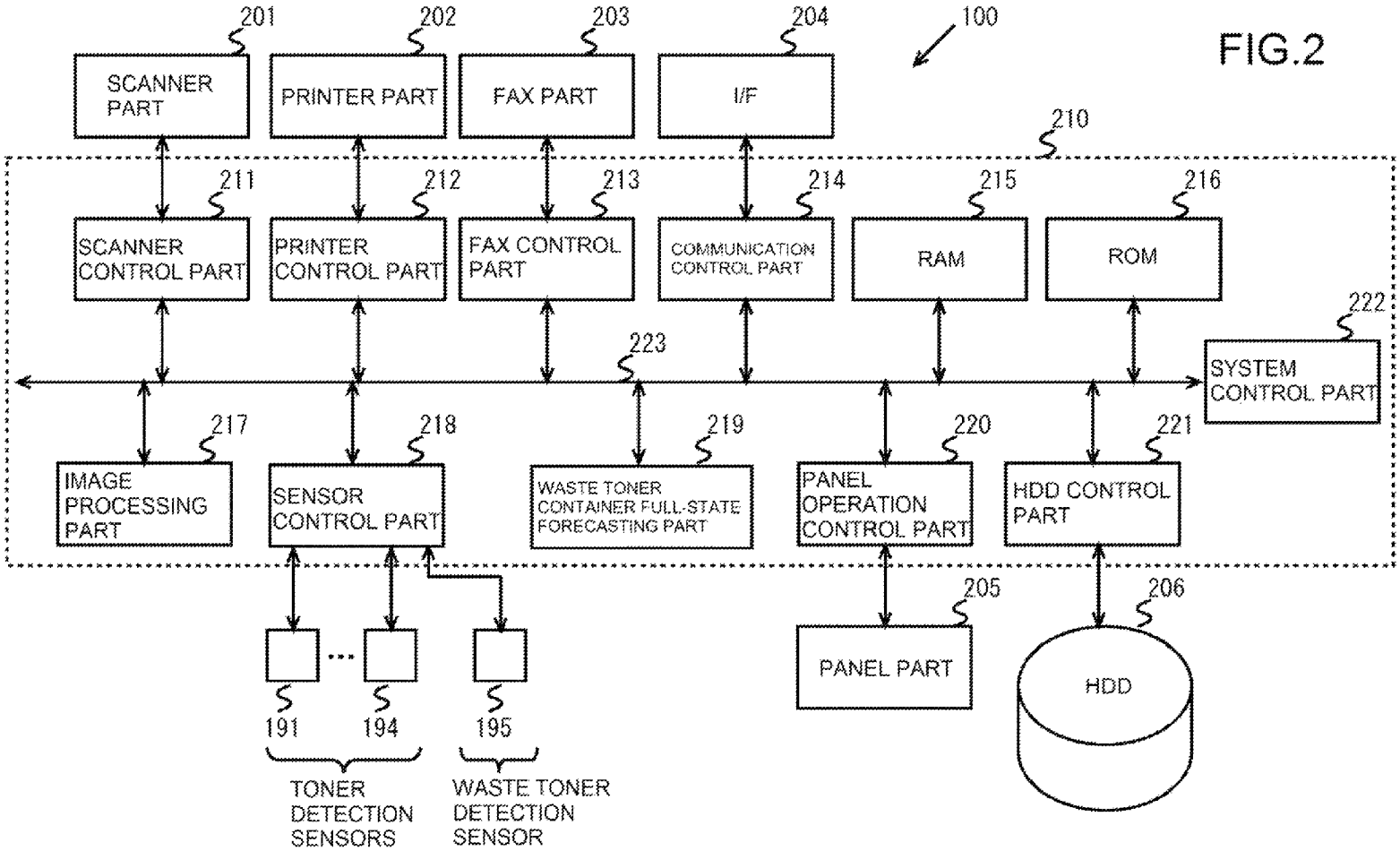
FIG. 2 gives an example of internal configuration of the MFP in FIG. 1.

Next, with reference to FIG. 2, an example of internal construction of the MFP 100 will be explained. The MFP 100 includes a scanner part 201, a printer part 202, a FAX part 203, an I/F (interface) 204, a panel part 205, an HDD 206, and a control part 210. The reference numerals 191 to 194 denote toner detection sensors that detect the quantity of the above-mentioned toner. In addition, the reference numeral 195 denotes a waste toner detection sensor that detects the accommodation quantity of the above-mentioned waste toner.

The scanner part 201 is a device that converts image signal of a document read by an image sensor into digital image data, and inputs it to the control part 210. The printer part 202 is a device that prints an image on the paper sheet 200 based on the image data outputted from the control part 210. The FAX part 203 is a device that transmits the image data outputted from the control part 210 to a facsimile on the opposite party through a telephone line, and receives image data from the facsimile on the opposite party to input it to the control part 210.

The I/F 204 takes charge of a communication with a user terminal, such as a PC (personal computer), through an in-house LAN (Local Area Network), or the like. The panel part 205 is a device that performs a display for the printing function, the copying function, the FAX function, and the transmitting/receiving function through a network of the MFP 100, or that for various settings. In addition, when a later-described waste toner container full-state forecasting part 219 forecasts the full state of the waste toner container 180*a*, the panel part 205 displays a replacement message that urges replacement of the waste toner container 180*a* under the control of a later-described panel operation control part 220 that is controlled by the system control part 222.

The HDD 206 is a storage device that stores application programs, and the like, for providing various functions of the MFP 100.

The control part 210 is a processor that executes the image forming program, the control program, and the like, to control the operation of the entire MFP 100. The control part 210 includes a scanner control part 211, a printer control part 212, a FAX (facsimile) control part 213, a communication control part 214, an RAM (Random Access Memory) 215, an ROM (Read-Only Memory) 216, an image processing part 217, a sensor control part 218, a waste toner container full-state forecasting part 219, a panel operation control part 220, an HDD control part 221, and a system control part 222. In addition, these are connected to a data bus 223.

The scanner control part 211 controls the reading operation of the scanner part 201. The printer control part 212 controls the printing operation of the printer part 202. The FAX control part 213 controls the image data transmitting/receiving operation by the FAX part 203. The communication control part 214 performs control of transmission/reception of data, or the like, by way of the in-house LAN, through the I/F 204.

The RAM 215 is a work memory for executing a program. The ROM 216 stores control programs to perform operation check, and the like, of the respective parts. The image processing part 217 performs an image processing operation (rasterizing) on the image data. The sensor control part 218 controls the detection operation of the toner detection sensors 191 to 194 and the waste toner detection sensor 195. In addition, when the toner detection sensors 191 to 194 detect an empty state of any one of the K toner container 110*a*, the Y toner container 120*a*, the M toner container 130*a*, and the C toner container 140*a*, the sensor control part 218 notifies the system control part 222 thereof. In addition, when the waste toner detection sensor 195 detects the accommodation quantity of the waste toner in the waste toner container 180*a*, the sensor control part 218 notifies the system control part 222 thereof.

As later described in detail, the waste toner container full-state forecasting part 219 stores the accommodation quantity of the waste toner in the waste toner container 180*a* at the time of replacement of the K toner container 110*a* at the previous time. In addition, when the K toner container 110*a* that is currently being used is emptied, the waste toner container full-state forecasting part 219 forecasts whether or not the waste toner container 180*a* for accommodating the waste toner will be filled up before the K toner container 110*a* that has been newly loaded is emptied, based on the result of detection by the waste toner detection sensor 195 (the accommodation quantity of the waste toner at this time) and the accommodation quantity of the waste toner at the previous time that is stored. In addition, if it is forecasted that the waste toner container 180*a* will be filled up, the waste toner container full-state forecasting part 219 notifies a replacement instruction to the system control part 222. Thereby, as described later, the system control part 222 causes the panel part 205 to display a replacement message for urging the replacement of the waste toner container 180*a*, through the panel operation control part 220.

In other words, the waste toner container full-state forecasting part 219 forecasts whether or not the waste toner container 180*a* will be filled up based on, for example, the following decision condition (1) or (2).

(1) (Accommodation quantity of waste toner at this time)−(accommodation quantity of waste toner at the previous time)<=(residual capacity of waste toner container 180*a*) . . . (forecasting that it will not be filled up, and thus does not cause any replacement message to be displayed)

(2) (Accommodation quantity of waste toner at this time)−(accommodation quantity of waste toner at the previous time)>(residual capacity of waste toner container 180*a*) . . . (forecasting that it will be filled up, and thus causes a replacement message to be displayed)

"Accommodation quantity of waste toner at this time" refers to the total accommodation quantity of the waste toner that will be accommodated in the waste toner container 180*a* at the point in time when the K toner container 110*a* that is currently used will have been emptied. Likewise, "accommodation quantity of waste toner at the previous time" refers to the total accommodation quantity of the waste toner that was accommodated in the waste toner container 180*a* at the point in time when the K toner container 110*a* that was being used at the previous time had been emptied. In addition, "residual capacity of waste toner container 180*a*" refers to the empty capacity of the waste toner container 180*a* that is available until the waste toner container 180*a* is filled up with the waste toner.

Here, for the decision condition (1), it is assumed that the accommodation quantity of the waste toner at this time is, for example, 60%, while the accommodation quantity of the waste toner at the previous time was, for example, 50%. In this situation, it can be confirmed that the accommodation quantity of the waste toner that is produced by using one K toner container 110*a* is 10%. Therefore, even if the K toner container 110*a* that has been newly loaded is used, the accommodation quantity of the waste toner at the next time will be 70%, and thus the container full-state forecasting part 219 forecasts that the waste toner container 180*a* will not be filled up. Therefore, in this situation, the waste toner container full-state forecasting part 219 will not issue a replacement instruction. Thereby, the system control part 222 will not cause a replacement message that urges the replacement of the waste toner container 180*a* to be displayed.

In addition, for the decision condition (2), it is assumed that the accommodation quantity of the toner at this time waste is, for example, 92%, while the accommodation quantity of the toner at the previous time was, for example, 80%. In this situation, in the same manner as above, it can be confirmed that the accommodation quantity of the waste toner that is produced by using one K toner container 110*a* is 12%. Therefore, in the situation where the K toner container 110*a* that has been newly loaded is used, the accommodation quantity of the waste toner at the next time will be 104%, and thus the container full-state forecasting part 219 forecasts that the waste toner container 180*a* will be filled up. Therefore, in this situation, the waste toner container full-state forecasting part 219 will issue a replacement instruction. Thereby, the system control part 222 will cause a replacement message that urges the replacement of the waste toner container 180*a* to be displayed.

In the above description, it is presupposed that whether or not the waste toner container 180*a* will be filled up is forecasted by the waste toner container full-state forecasting part 219 at the point in time when the K toner container 110*a* has been emptied. The reason why such presupposition has been given lies in the fact that the frequency of use of the toner in the K toner container 110*a* is extremely high, as compared to that of the toner in the other toner containers, i.e., the Y toner container 120*a*, the M toner container 130*a*, and the C toner container 140*a*. In other words, the replacement cycle time for the K toner container 110*a* is short, as compared to that for the other toner containers, i.e., the Y toner container 120*a*, the M toner container 130*a*, and the C toner container 140*a*. From this fact, if forecasting of whether or not the waste toner container 180*a* will be filled up is performed at the point in time when the K toner container 110*a* has been emptied, replacement of the waste toner container 180*a* can be urged before the waste toner container 180*a* being filled up with the waste toner that has been accommodated. Yet, as described above, when the waste toner container 180*a* is filled up with the waste toner that has been accommodated, and is replaced, the K toner container 110*a* that has been emptied is reused to be loaded in the waste toner accommodating box 188. Also from this fact, when it has been forecasted that the waste toner container 180*a* will be filled up, the K toner container 110*a* that has been emptied can be loaded in the waste toner accommodating box 188 as it is, whereby replacement of the waste toner container 180*a* can be efficiently performed.

In addition, besides the decision conditions (1) and (2), it can be also schemed that the result of measurement of the accommodation quantity of the waste toner that is produced by using only one K toner container 110*a* is previously stored, and every time replacement of the K toner container 110*a* is performed, the result of measurement that has been obtained is added to the accommodation quantity of the waste toner that has been previously stored by the waste toner container full-state forecasting part 219, thereby, with the use of the added value, whether or not the waste toner container 180*a* will be filled up at the time of replacement of the K toner container 110*a* being forecasted. However, in the situation where, besides the K toner container 110*a*, the color toner containers, i.e., the Y toner container 120*a*, the M toner container 130*a*, and the C toner container 140*a* are used, the color toner that has been removed from the respective photosensitive drums 121 to 141 is added as the waste toner. In this situation, there is produced an error in the forecasting by the container full-state forecasting part 219 of whether or not the waste toner container 180*a* will be filled up. Therefore, in any embodiment of the present disclosure, the container full-state forecasting part 219 forecasts whether or not the waste toner container 180*a* will be filled up based on the difference between the accommodation quantity of the waste toner at this time and the accommodation quantity of the waste toner at the previous time as can be seen from the above-mentioned decision condition (1) or (2).

The panel operation control part 220 controls the display operation of the panel part 205. The HDD control part 221 controls the operation, such as reading/writing of data from/into the HDD 206. The system control part 222 controls cooperative operation of the respective parts, and the like. In addition, when the system control part 222 receives a notification from the waste toner container full-state forecasting part 219 that there is the need for replacement of the waste toner container 180*a*, the system control part 222 causes the panel part 205 to display a replacement message that urges the replacement of the waste toner container 180*a*, through the panel operation control part 220.

As described above, in the situation where the waste toner container full-state forecasting part 219 has forecasted that, at the next time of replacement of the K toner container 110*a*, replacement of the waste toner container 180*a* will be required, the system control part 222 may cause the panel part 205 to display a message that raises attention, through the panel operation control part 220.

Figure 3:
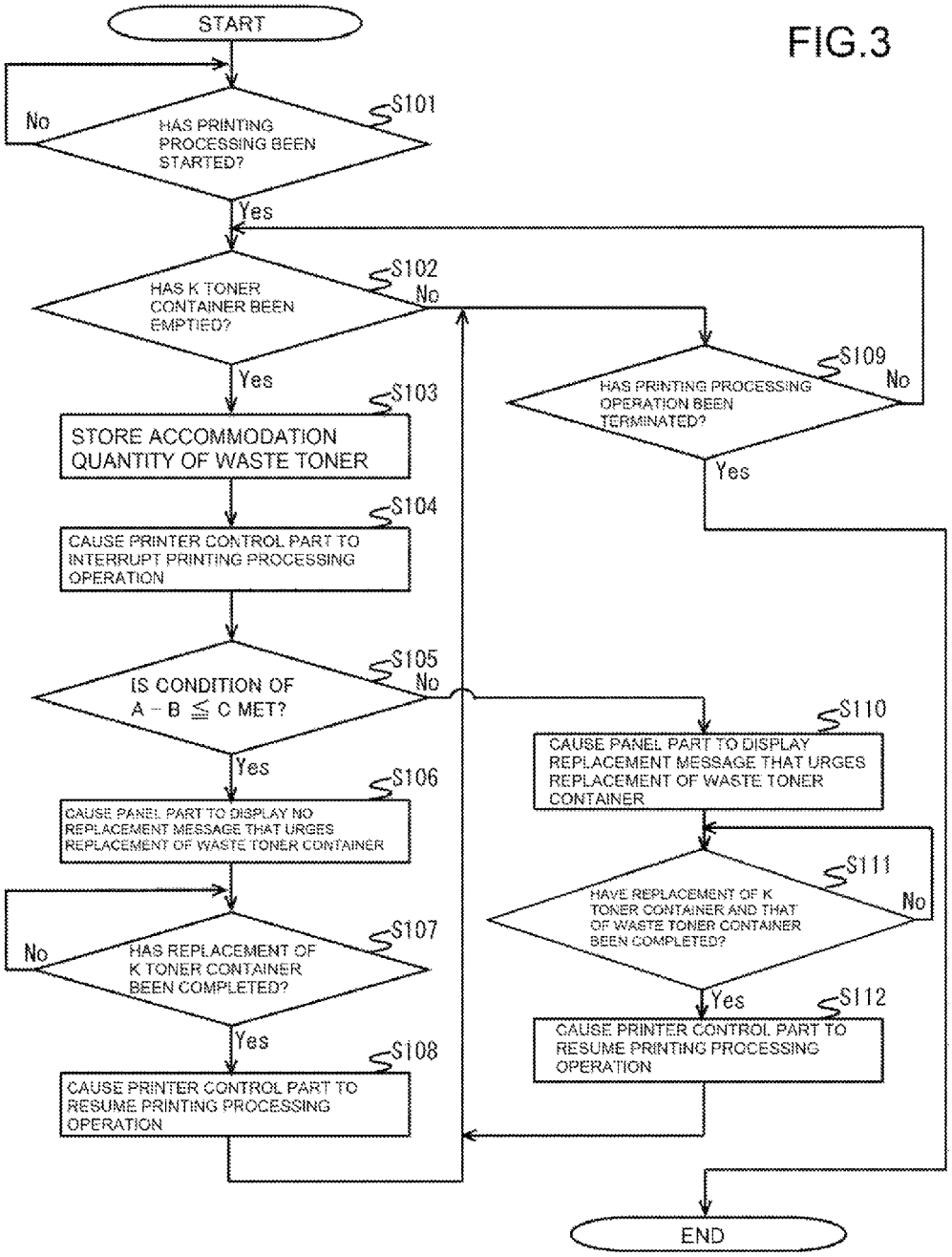
FIG. 3 illustrates the steps of processing that is executed based on the method for forecasting the full state of a waste toner container in the MFP in FIG. 1.

Next, with reference to FIG. 3 and FIG. 4A, a method for forecasting the full state of the waste toner container 180*a* will be explained. Hereinbelow, explanation will be made on the assumption that "(accommodation quantity of waste toner at this time)" is A, "(accommodation quantity of waste toner at the previous time)" is B, and "(residual capacity of waste toner container 180*a*)" is C. In addition, hereinbelow, it is assumed that the MFP 100 executes printing processing.

(Step S101)

First, the system control part 222 determines whether or not the printing processing has been started. In this situation, the system control part 222 waits until it receives a notification that a printing instruction has been given from, for example, the panel operation control part 220 shown in FIG. 2, through the panel part 205 (NO at Step S101), and upon the notification having been received, determines that the printing processing has been started (YES at Step S101).

At this time, the system control part 222 causes the image processing part 217 to make an image processing operation (rasterizing) on the image data. In addition, the system control part 222 instructs the printer control part 212 to perform printing on the paper sheet 200 with the printer part 202, based on the image processing operation (rasterizing) made by the image processing part 217.

Thereby, the image forming parts 110 to 140 shown in FIG. 1 write in an electrostatic latent image on the photosensitive drums 111 to 141, respectively, according to the printing data. In addition, the developing devices 113 to 143 develop the electrostatic latent image, respectively, with the toners in the K toner container 110*a*, the Y toner container 120*a*, the M toner container 130*a*, and the C toner container 140*a*. Then, the primary transfer devices 114 to 144 transfer the toner images on the photosensitive drums 111 to 141 to the intermediate transfer belt 151, respectively.

In addition, the secondary transfer part 160 transfers the toner images that have been transferred to the intermediate transfer belt 151 to the paper sheet 200. Then, the fixing part 170 welds the toner images to the paper sheet 200.

In addition, after the toner images having been transferred to the paper sheet 200, the blade 181 in the cleaning parts 182 to 185 removes the toner (waste toner) that has been left on the surface of the photosensitive drums 111 to 141, respectively. The waste toner that has been removed is led by the waste toner paths 186*a* to 186*d* down to the waste toner path 186*e*. Then, the spiral screw 187 in the waste toner path 186*e* leads the waste toner to the waste toner accommodating box 188. The waste toner that has been led by the spiral screw 187 is accommodated in the waste toner container 180*a*.

(Step S102)

The system control part 222 determines whether or not the K toner container 110*a* has been emptied. In this situation, if there is no notification of the result of detection by the toner detection sensor 191 from the sensor control part 218 shown in FIG. 2, the system control part 222 determines that the K toner container 110*a* has not been emptied (NO at Step S102), and proceeds to Step S109. The result of detection by the toner detection sensor 191 refers to the result of the toner detection sensor 191 having detected that the K toner container 110*a* is empty.

If the system control part 222 receives a notification of the result of detection by the toner detection sensor 191 from the sensor control part 218, the system control part 222 determines that the K toner container 110*a* has been emptied (YES at Step S102), and proceeds to Step S103.

(Step S103)

The waste toner container full-state forecasting part 219 receives the result of detection by the waste toner detection sensor 195 at the point in time when the K toner container 110*a* has been emptied from the sensor control part 218, and stores the accommodation quantity of the waste toner.

(Step S104)

The system control part 222 causes the printer control part 212 to interrupt the printing processing operation.

(Step S105)

The system control part 222 causes the waste toner container full-state forecasting part 219 to forecast whether or not the replacement of the waste toner container 180*a* is required. In this situation, the waste toner container full-state forecasting part 219 checks whether or not the condition of A−B<=C is met. Here, as described above, A is "(accommodation quantity of waste toner at this time)" at the point in time when the K toner container 110*a* has been emptied; B is "(accommodation quantity of waste toner at the previous time)" that has been stored at Step S103; and C is "(residual capacity of waste toner container 180*a*)".

In other words, as described above, A, which is the accommodation quantity of the waste toner at this time, is assumed to be, for example, 60%, and B, which is the accommodation quantity of the waste toner at the previous time, is assumed to be, for example, 50%. In this situation, it can be confirmed that the accommodation quantity of the waste toner that is produced by using one K toner container 110*a* is 10%. Therefore, even if the K toner container 110*a* that has been newly loaded is used, the accommodation quantity of the waste toner at the next time is 70%, and thus the container full-state forecasting part 219 forecasts that the waste toner container 180*a* will not be filled up (YES at Step S105), proceeding to Step S106.

In this situation, the waste toner container full-state forecasting part 219 does not notify the system control part 222 of a replacement instruction that the waste toner container 180*a* is required to be replaced.

Contrarily, it is assumed that A, which is the accommodation quantity of the waste toner at this time, is, for example, 92%, and B, which is the accommodation quantity of the waste toner at the previous time, is, for example, 80%. In this situation, in the same manner as described above, it can be determined that the accommodation quantity of the waste toner that is produced by using one K toner container 110*a* is 12%. Therefore, in the situation where the K toner container 110*a* that has been newly loaded is used, the accommodation quantity of the waste toner at the next time is 104%, the container full-state forecasting part 219 forecasts that the waste toner container 180*a* will be filled up (NO at Step S105), proceeding to Step S110.

In this situation, the waste toner container full-state forecasting part 219 notifies the system control part 222 of a replacement instruction that the waste toner container 180*a* is required to be replaced.

(Step S106)

Since the system control part 222 has not received a notification of a replacement instruction for the waste toner container 180*a* from the waste toner container full-state forecasting part 219, the system control part 222 does not cause the panel part 205 to display a replacement message that urges replacement of the waste toner container 180*a*.

(Step S107)

The system control part 222 determines whether or not the replacement of the K toner container 110*a* has been completed.

In this situation, the system control part 222 waits until it receives a notification of the result of detection by the toner detection sensor 191 from the sensor control part 218 (NO at Step S107), and upon having received a notification of the result of detection by the toner detection sensor 191 from the sensor control part 218, the system control part 222 determines that the replacement of the K toner container 110*a* has been completed (YES at Step S107), proceeding to Step S108. The result of detection by the toner detection sensor 191 in this situation refers to the result of the toner detection sensor 191 having detected that the K toner container 110*a* is filled up with the toner.

(Step S108)

If the system control part 222 determines that replacement of the K toner container 110*a* has been completed, the system control part 222 causes the printer control part 212 to resume the printing processing operation.

(Step S109)

The system control part 222 determines whether or not the printing processing operation has been terminated.

In this situation, if there is not given a notification of termination of the printing processing from the printer control part 212, the system control part 222 determines that the printing processing operation has not been terminated (NO at Step S109), proceeding to Step S102.

Contrarily, if there has been given a notification of termination of the printing processing operation from the printer control part 212, the system control part 222 determines that the printing processing operation has been terminated (YES at Step S109), terminating a series of processes.

(Step S110)

If the system control part 222 receives a notification of a replacement instruction for the waste toner container 180*a* from the waste toner container full-state forecasting part 219, the system control part 222 causes the panel part 205 to display a replacement message that urges replacement of the waste toner container 180*a*, through the panel operation control part 220.

(Step S111)

The system control part 222 determines whether or not replacement of the K toner container 110*a* and that of the waste toner container 180*a* have been completed.

In this situation, the system control part 222 waits until it receives a notification of the result of detection by the toner detection sensor 191 from the sensor control part 218 (NO at Step S111), and upon having received a notification of the result of detection by the toner detection sensor 191 from the sensor control part 218, the system control part 222 determines that replacement of the K toner container 110*a* has been completed (YES at Step S111). The result of detection by the toner detection sensor 191 in this situation refers to the result of the toner detection sensor 191 having detected that the K toner container 110*a* is filled up with the toner.

In addition, the system control part 222 waits until it receives a notification of the result of detection by the waste toner detection sensor 195 from the sensor control part 218 (NO at Step S111), and upon having received a notification of the result of detection by the waste toner detection sensor 195 from the sensor control part 218, the system control part 222 determines that replacement of the waste toner container 180*a* has been completed (YES at Step S111). The result of detection by the waste toner detection sensor 195 in this situation refers to the result of the waste toner detection sensor 195 having detected that the waste toner container 180*a* is empty.

(Step S112)

If the system control part 222 determines that replacement of the K toner container 110*a* and that of the waste toner container 180*a* have been completed, the system control part 222 causes the printer control part 212 to resume the printing processing operation.

Next, with a timing chart shown in FIG. 4A, the replacement timing for the waste toner container 180*a* based on the method for forecasting the full state of the waste toner container 180*a* by the waste toner container full-state forecasting part 219 will be explained.

Figure 4A:
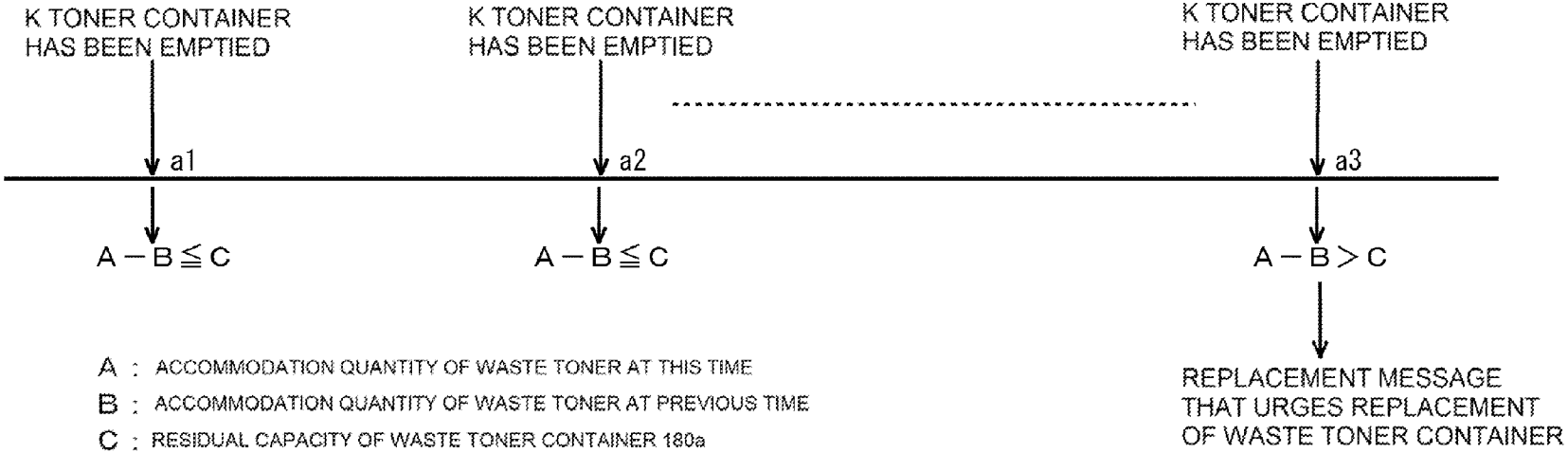
FIG. 4A is a figure illustrating the method for forecasting the full state of a waste toner container in the MFP in FIG. 1, giving a timing chart in the situation where, at the point in time when the K toner container has been emptied, it is forecasted whether or not replacement of the waste toner container is required.

In other words, in the situation where, even if the K toner container 110*a* has been emptied at points in time of a1 and a2 in FIG. 4A, the condition of A−B<=C is met, the waste toner container full-state forecasting part 219 forecasts that the waste toner container 180*a* will not be filled up. In this situation, no replacement message that urges replacement of the waste toner container 180*a* will be displayed. Then, if the K toner container 110*a* has been emptied at a point in time of a3, resulting in the condition of A−B>C being met, the waste toner container full-state forecasting part 219 forecasts that the waste toner container 180*a* will be filled up. In this situation, a replacement message that urges replacement of the waste toner container 180*a* will be displayed. Thereby, since, at the point in time of a3, it is forecasted that the waste toner container 180*a* will be filled up with the waste toner, the waste toner container 180*a* can be replaced at this point in time.

In this way, the need for replacing the waste toner container 180*a* every time the K toner container 110*a* is replaced at the points in time of a1 and a2 is eliminated, the replacement frequency for the waste toner container 180*a* can be lowered. Generally, the consumption quantity of K toner is larger than that of a color toner other than black. Therefore, the number of times when the K toner container 110*a* is emptied is larger than that when any one of the color toner containers (120*a*, 130*a*, and 140*a*) is emptied. In other words, if the point in time when the K toner container 110*a* has been emptied is used as a criterion, the frequency of the waste toner container full-state forecasting part 219 forecasting that the waste toner container 180*a* will be filled up is increased. Therefore, at the point in time of a3 when it has been forecasted that the waste toner container 180*a* will be filled up with the waste toner, the possibility is high that the waste toner is accommodated in the waste toner container 180*a* to a level near the full, whereby the residual capacity of the waste toner container 180*a* can be reduced, and thus the accommodation of the waste toner by the waste toner container 180*a* can be efficiently performed.

With the replacement timing for the waste toner container 180*a* based on the method for forecasting the full state of the waste toner container 180*a* as described above, the point in time when the K toner container 110*a* has been emptied is used as a criterion. Besides this, there may be added a replacement timing for the waste toner container 180*a* with which the point in time when anyone of the Y toner container 120*a*, the M toner container 130*a* and the C toner container 140*a* other than the K toner container 110*a* has been emptied is used as a criterion.

Figure 4B:
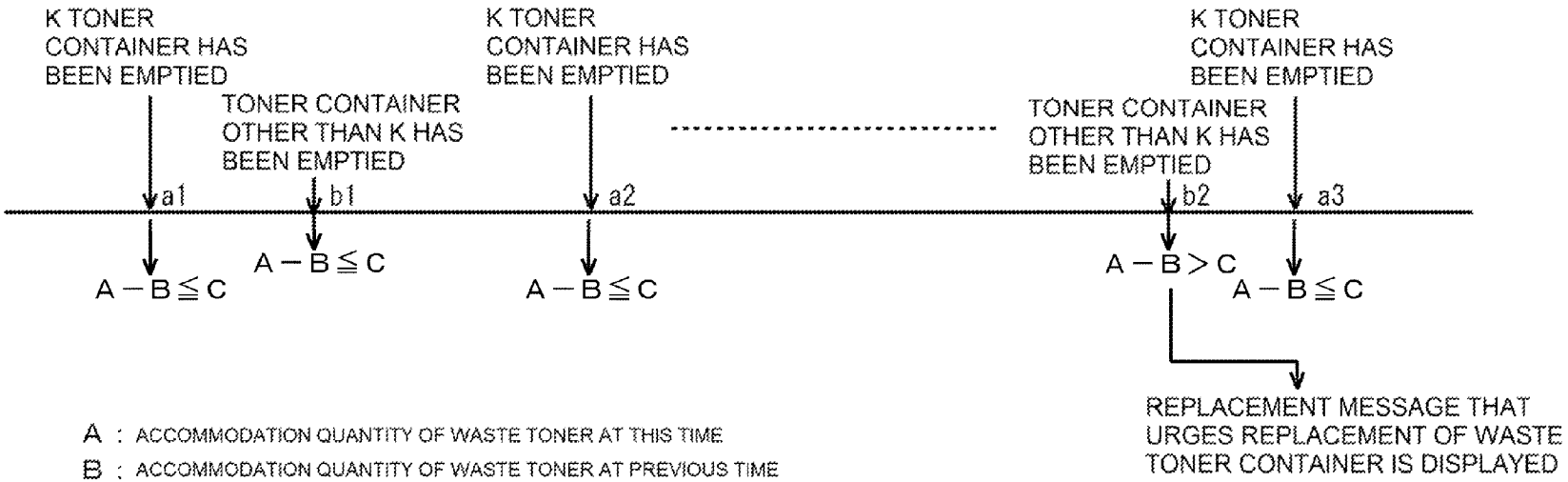
FIG. 4B is a figure illustrating the method for forecasting the full state of a waste toner container in the MFP in FIG. 1, giving a timing chart in which there has been added a situation where, at the point in time when any one of the Y toner container, the M toner container and the C toner container other than the K toner container has been emptied, it is forecasted whether or not replacement of the waste toner container is required.

In other words, as shown in FIG. 4B, it is assumed that any one of the Y toner container 120*a*, the M toner container 130*a* and the C toner container 140*a* other than the K toner container 110*a* has been emptied at a point in time of b1. At this point in time of b1, since the condition of A−B<=C is met, it is forecasted in the same manner as described above that the waste toner container 180*a* will not be filled up with the waste toner, and thus no replacement message that urges replacement of the waste toner container 180*a* will be displayed.

On the other hand, it is assumed that any one of the Y toner container 120*a*, the M toner container 130*a* and the C toner container 140*a* other than the K toner container 110*a* has been emptied at a point in time of b2. At this point in time of b2, since the condition of A−B>C is met, it is forecasted in the same manner as described above that the waste toner container 180*a* will be filled up with the waste toner, and thus a replacement message that urges replacement of the waste toner container 180*a* will be displayed.

Even if the K toner container 110*a* has been emptied at the point in time of a3, the waste toner container 180*a* has been replaced at the point in time of b2 just before the point in time of a3, resulting in the condition of A−B<=C having been met, and thus no replacement message that urges replacement of the waste toner container 180*a* will be displayed.

Thus, in the situation where whether or not any one of the Y toner container 120*a*, the M toner container 130*a* and the C toner container 140*a* other than the K toner container 110*a* has been emptied is added as a criterion for the replacement timing for the waste toner container 180*a*, even if the consumption quantity of the toner for any one of the Y toner container 120*a*, the M toner container 130*a* and the C toner container 140*a* is increased, the replacement frequency for the waste toner container 180*a* can be decreased, and the accommodation of the waste toner by the waste toner container 180*a* can be efficiently performed.

By the way, with the MFP 100, a color adjustment by the color calibration, or the like, is performed at the time of power being turned on. At that time, all the toners in the K toner container 110*a*, the Y toner container 120*a*, the M toner container 130*a* and the C toner container 140*a* are used. In this situation, all the toners that have been used after the color adjustment are discarded, and thus with the MFP 100, with which the power is frequently turned on, the discarded quantities of the color toners in the toner containers other than the K toner container 110*a* are increased. Therefore, by adding a replacement timing for the waste toner container 180*a* with which the point in time when any one of the non-black color toner containing-toner containers other than the K toner container 110*a* has been emptied is used as a criterion, even with, for example, the MFP 100, with which the power is frequently turned on, the waste toner container full-state forecasting part 219 can more accurately forecast whether or not the waste toner container 180*a* will be filled up with the waste toner.

Besides the above schemes, the waste toner container full-state forecasting part 219 may forecast whether or not the waste toner container 180*a* will be filled up with the waste toner before a toner container that has been newly loaded is emptied, with the point in time when any one of the non-black color toner containing-toner containers other than the K toner container 110*a* has been emptied being used as a criterion. In an environment in which color printing is more often conducted than monochrome printing, such scheme can reduce the replacement frequency for the waste toner container 180*a*, and allows the accommodation of the waste toner by the waste toner container 180*a* to be efficiently performed.

In addition, the waste toner container full-state forecasting part 219 may count the number of times when the toner container has been emptied, and at the point in time when the toner container with which the number of times when it was emptied is the largest among the K toner container 110*a*, the Y toner container 120*a*, the M toner container 130*a*, and the C toner container 140*a* has been emptied, may forecast whether or not the waste toner container 180*a* will be filled up with the waste toner. In this situation, by using one toner container having been emptied as a criterion, the replacement frequency for the waste toner container 180*a* can be reduced, and the accommodation of the waste toner by the waste toner container 180*a* can be efficiently performed.

In addition, in the situation where the number of times when the K toner container 110*a* was emptied is larger than the total number of times when the Y toner container 120*a*, the M toner container 130*a*, and the C toner container 140*a* were emptied, the waste toner container full-state forecasting part 219 may forecast whether or not the waste toner container 180*a* will be filled up with the waste toner, at the point in time when the K toner container 110*a* has been emptied. Further, in the situation where the total number of times when the Y toner container 120*a*, the M toner container 130*a*, and the C toner container 140*a* were emptied is larger than the number of times when the K toner container 110*a* was emptied, the waste toner container full-state forecasting part 219 may forecast whether or not the waste toner container 180*a* will be filled up with the waste toner, at the point in time when any one of the Y toner container 120*a*, the M toner container 130*a*, and the C toner container 140*a* has been emptied. With these schemes, that the toner container for the printing mode that is more often selected from between the monochrome printing mode and the color printing mode has been emptied is used as a criterion, whereby the replacement frequency for the waste toner container 180*a* can be reduced, and the accommodation of the waste toner by the waste toner container 180*a* can be efficiently performed.

In addition, the waste toner container full-state forecasting part 219 may count the number of times when the toner container has been emptied, and at the point in time when a toner container of the K toner container 110*a*, the Y toner container 120*a*, the M toner container 130*a*, and the C toner container 140*a* with which the number of times when it was emptied is larger than a specific criterion value has been emptied, may forecast whether or not the waste toner container 180*a* will be filled up with the waste toner. Here, the specific criterion value may be, for example, an average value per one toner container of the numbers of times when the toner containers were emptied. In this situation, that a toner container with which the frequency of being emptied is relatively high has been emptied is used as a criterion, whereby the replacement frequency for the waste toner container 180*a* can be reduced, and the accommodation of the waste toner by the waste toner container 180*a* can be efficiently performed.

In the above scheme, the number of times when the toner container has been emptied may be counted every specific time period (for example, one year, or the like), or every total number of times when the toner containers have been emptied (for example, each time the total of the numbers of times when the K toner container 110*a*, the Y toner container 120*a*, the M toner container 130*a*, and the C toner container 140*a* have been emptied reaches ten, or the like).

In this way, in the present embodiment, when the toner detection sensor 191, for example, detects an empty state of the K toner container 110*a* (the toner container), the waste toner container full-state forecasting part 219 forecasts whether or not the waste toner container 180*a* will be filled up with the waste toner before the K toner container 110*a* that has been newly loaded is emptied, based on the result of detection by the waste toner detection sensor 195 that detects the accommodation quantity of the waste toner that has been removed from the photosensitive drums 111 to 141 that are the photosensitive media, and has been accommodated in the waste toner container 180*a*. Then, if the waste toner container full-state forecasting part 219 forecasts that the waste toner container 180*a* will be filled up, the system control part 222 causes the panel part 205 to display a replacement message that urges replacement of the waste toner container 180*a*.

In other words, in the situation where the difference between the accommodation quantity of the waste toner at this time that has been detected by the waste toner detection sensor 195 at the point in time when the K toner container 110*a* at this time has been emptied, and the accommodation quantity of the waste toner at the previous time that was detected by the waste toner detection sensor 195 at the point in time when the K toner container 110*a* at the previous time was emptied is larger than the residual capacity of the waste toner container 180*a*, the waste toner container full-state forecasting part 219 notifies the system control part 222 of a replacement instruction.

Thereby, a replacement message that urges replacement is displayed at the point in time when it is forecasted that the waste toner container 180*a* will be filled up with the waste toner before the K toner container 110*a* that has been newly loaded is emptied, whereby the replacement frequency for the waste toner container can be reduced, and the accommodation of the waste toner by the waste toner container can be efficiently performed.

The criterion for use in determining whether or not the waste toner container 180*a* has been filled up may be 100% of the capacity of the waste toner container 180*a*, or 90% or so of the same. In other words, in the situation where the accommodation quantity of the waste toner in the waste toner container 180*a* is equal to or over a specific accommodation quantity that does not exceed the capacity of the waste toner container 180*a* (the capacity when the waste toner container 180*a* is empty), it can be determined that the waste toner container 180*a* is in the state of being filled up. Here, the specific accommodation quantity may be under the capacity of the waste toner container 180*a* as a design value that takes into account of the convenience in replacement, and the like, of the waste toner container 180*a* (for example, the convenience for suppressing the scattering of the waste toner, and the like). In addition, the specific accommodation quantity may be set at a value under the capacity of the waste toner container 180*a* in consideration of the residual capacity that can absorb a possible error in the forecasting by the waste toner container full-state forecasting part 219.

In addition, in the present embodiment, the forecasting performed by the waste toner container full-state forecasting part 219 of whether or not the waste toner container 180*a* will be filled up with the waste toner has been explained as that which is performed by using the difference between the accommodation quantity of the waste toner at this time and the accommodation quantity of the waste toner at the previous time.

Besides this scheme, every time the K toner container 110*a* has been emptied, the difference between the accommodation quantity of the waste toner at this time that has been detected by the waste toner detection sensor 195 at the point in time when the K toner container 110*a* at this time has been emptied, and the accommodation quantity of the waste toner at the previous time that was detected by the waste toner detection sensor 195 at the point in time when the K toner container 110*a* at the previous time was emptied may be stored in the HDD 206, or the like, to determine the average value of the differences, and in the situation where the average value exceeds the residual capacity of the waste toner container 180*a*, the waste toner container full-state forecasting part 219 may notify the system control part 222 of a replacement instruction. In this situation, the possible error in the forecasting by the waste toner container full-state forecasting part 219 can be decreased.

In addition, every time the K toner container 110*a* has been emptied, the difference between the accommodation quantity of the waste toner at this time that has been detected by the waste toner detection sensor 195 at the point in time when the K toner container 110*a* at this time has been emptied, and the accommodation quantity of the waste toner at the previous time that was detected by the waste toner detection sensor 195 at the point in time when the K toner container 110*a* at the previous time was emptied may be stored in the HDD 206, or the like, to determine a maximum value of the difference, and in the situation where the maximum value exceeds the residual capacity of the waste toner container 180*a*, the waste toner container full-state forecasting part 219 may notify the system control part 222 of a replacement instruction. Also in this situation, the possible error in the forecasting by the waste toner container full-state forecasting part 219 can be decreased.

In addition, every time the K toner container 110*a* has been emptied, the accommodation quantity of the waste toner may be stored to determine the tendency of increase in the accommodation quantity of the waste toner, and based on the tendency of increase that has been determined, the waste toner container full-state forecasting part 219 may perform forecasting of whether or not the waste toner container 180*a* will be filled up. In other words, in the situation where the replacement cycle time for the K toner container 110*a* is short, the waste toner container 180*a* will be filled up in a short period of time. Contrarily, in the situation where the replacement cycle time for the K toner container 110*a* is long, the waste toner container 180*a* will be filled up in a long period of time. Here, particularly in the situation where the replacement cycle time for the K toner container 110*a* is long, the replacement cycle time in the forecasting by the waste toner container full-state forecasting part 219 of whether or not the waste toner container 180*a* will be filled up is long. In this situation, the toners in the Y toner container 120*a*, the M toner container 130*a*, and the C toner container 140*a* other than the K toner container 110*a* are accommodated in the waste toner container 180*a* as the waste toner, and therefore, there is the possibility that the forecasting at the point in time when the K toner container 110*a* has been emptied may involve an error. Then, by providing a condition that, at an accommodation rate (e.g., percentage) for the waste toner container 180*a* of, for example, 90% (a threshold value), the waste toner container 180*a* is to be determined to be in the state of being filled up, even in the situation where the replacement cycle time for the K toner container 110*a* is long, the possible error in the forecasting by the waste toner container full-state forecasting part 219 can be decreased.

In other words, the longer the replacement cycle time for a specific toner container, the lower the waste toner container full-state forecasting part 219 will set the accommodation rate (the threshold value) at which the waste toner container 180*a* is determined to be in the state of being filled up. Specifically, for example, in the situation where the replacement cycle time for a specific toner container has become longer than the criterion value (for example, the design value), the accommodation rate for the waste toner at which the waste toner container 180*a* is determined to be in the state of being filled up may be a value obtained by the criterion value of the replacement cycle time that is divided by the replacement cycle time for the specific toner container. In this situation, the capacity of the waste toner container 180*a* at which it is determined to be in the state of being filled up may be calculated by using the following formula:

Capacity at which waste toner container 180*a* is determined to be in the state of being filled up=

(Capacity at which waste toner container 180*a* can accommodate waste toner)×(Criterion value of replacement cycle time)/(Replacement cycle time for specific toner container)

In addition, every time the K toner container 110*a* has been emptied, the waste toner container full-state forecasting part 219 may determine the number of printing copies, the number of characters, and the like, and based on the tendency of increase in number of printing copies, number of characters, and the like, may perform forecasting of whether or not the waste toner container 180*a* will be filled up.

In addition, the replacement message may be outputted by voice. In this situation, as components equivalent to the panel part 205 and the panel operation control part 220, the MFP 100 includes a voice outputting part provided with a speaker and a voice outputting control part that outputs a replacement message to the voice outputting part, respectively.

In addition, the replacement message may be outputted to a user terminal by communication. In this situation, instead of the panel operation control part 220, the I/F 204 and the communication control part 214 are used. The communication control part 214 transmits the replacement message to the user terminal through the I/F 204.

In addition, in the present embodiment, mainly based on that the K toner container 110*a* has been emptied, it has been forecasted whether or not the waste toner container 180*a* will be filled up with the waste toner before the K toner container 110*a* that has been newly loaded is emptied, however, based on that a toner container other than the K toner container 110*a* has been emptied, it may be forecasted in the same manner as in the situation where the K toner container 110*a* is used as a criterion.

In the above-mentioned typical system of image forming apparatus, if it is detected by a first detection means that the toner capacity has been reduced to below a first threshold, issue of a first alarm is started, and if it is detected by a second detection means that the waste toner box has been removed and loaded, the issue of the first alarm is terminated. Thereby, based on the replacement timing for the toner cartridge, the replacement time for the waste toner box can be reported.

By the way, the quantity of the toner that is removed from the photosensitive drum every time the toner image is transferred to a paper sheet is extremely small. Therefore, comparison of the consumption quantity of the toner in the toner cartridge per unit time with the accumulation quantity of the waste toner in the waste toner box per unit time indicates that the consumption quantity of the toner in the toner cartridge is far larger than the accumulation quantity of the waste toner in the waste toner box.

From such a fact, it has been presented a problem that, if the issue of the first alarm is also used as a report of the replacement timing for the waste toner box, the replacement timing for the waste toner box is reported for each replacement of the toner cartridge in spite of that the accumulation quantity of the waste toner in the waste toner box is small.

According to the image forming apparatus of the present disclosure, if the waste toner container full-state forecasting part forecasts that the waste toner container will be filled up, the system control part causes the panel part to display a replacement message that urges replacement of the waste toner container, whereby the replacement frequency for the waste toner container can be reduced, and the accommodation of the waste toner with the waste toner container can be efficiently performed.

What is claimed is:

1. An image forming apparatus, comprising:

a plurality of toner containers, a toner detection sensor that detects a quantity of a toner in a toner container of the plurality of toner containers, a waste toner detection sensor that detects an accommodation quantity of a waste toner that has been accommodated in a waste toner container, the waste toner having been removed from a photosensitive medium, a waste toner container full-state forecasting part that, upon the toner detection sensor detecting an empty state of the toner container, forecasts whether or not the waste toner container will be filled up with the waste toner before a toner container that has been newly loaded is emptied, based on the result of detection by the waste toner detection sensor, and a system control part that, upon the waste toner container full-state forecasting part forecasting that the waste toner container will be filled up, notifies a replacement message that urges replacement of the waste toner container to a panel part, wherein the waste toner container full-state forecasting part forecasts whether or not the waste toner container will be filled up with the waste toner at the point in time when at least one specified toner container is emptied, the waste toner container full-state forecasting part counts the number of times that the plurality of toner containers have been emptied, and at the point in time when a toner container with which the number of times when it was emptied is the largest has been emptied, the waste toner container full-state forecasting part forecasts whether or not the waste toner container will be filled up with the waste toner.

2. The image forming apparatus according to claim 1, wherein, in the situation where the difference between the accommodation quantity of the waste toner at this time that has been detected by the waste toner detection sensor at the point in time when the toner container at this time has been emptied, and the accommodation quantity of the waste toner at the previous time that was detected by the waste toner detection sensor at the point in time when the toner container at the previous time was emptied exceeds the residual capacity of the waste toner container, the waste toner container full-state forecasting part notifies a replacement instruction to the system control part.

3. The image forming apparatus according to claim 1, wherein, every time the toner container is emptied, the waste toner container full-state forecasting part stores the difference between the accommodation quantity of the waste toner at this time that has been detected by the waste toner detection sensor at the point in time when the toner container at this time has been emptied, and the accommodation quantity of the waste toner at the previous time that was detected by the waste toner detection sensor at the point in time when the toner container at the previous time was emptied, to determine an average value or maximum value of the differences, and in the situation where the average value or maximum value exceeds the residual capacity of the waste toner container, notifies a replacement instruction to the system control part.

4. An image forming apparatus, comprising:

a plurality of toner containers, a toner detection sensor that detects a quantity of a toner in a toner container of the plurality of toner containers, a waste toner detection sensor that detects an accommodation quantity of a waste toner that has been accommodated in a waste toner container, the waste toner having been removed from a photosensitive medium, a waste toner container full-state forecasting part that, upon the toner detection sensor detecting an empty state of the toner container, forecasts whether or not the waste toner container will be filled up with the waste toner before a toner container that has been newly loaded is emptied, based on the result of detection by the waste toner detection sensor, and a system control part that, upon the waste toner container full-state forecasting part forecasting that the waste toner container will be filled up, notifies a replacement message that urges replacement of the waste toner container to a panel part, wherein the waste toner container full-state forecasting part forecasts whether or not the waste toner container will be filled up with the waste toner at the point in time when at least one specified toner container is emptied, the plurality of toner containers accommodate a black toner and a plurality of color toners, respectively, and the waste toner container full-state forecasting part counts a first number of times that the toner container that accommodates the black toner has been emptied, and a second number of times indicating a total number of times that the toner containers that accommodate the plurality of color toners have been emptied, in the situation where the first number of times is larger than the second number of times, forecasts whether or not the waste toner container will be filled up with the waste toner at the point in time when the toner container that accommodates the black toner has been emptied, and in the situation where the second number of times is larger than the first number of times, forecasts whether or not the waste toner container will be filled up with the waste toner at the point in time when the toner container that accommodates any one of the plurality of color toners has been emptied.

5. An image forming apparatus, comprising:

a plurality of toner containers, a toner detection sensor that detects a quantity of a toner in a toner container of the plurality of toner containers, a waste toner detection sensor that detects an accommodation quantity of a waste toner that has been accommodated in a waste toner container, the waste toner having been removed from a photosensitive medium, a waste toner container full-state forecasting part that, upon the toner detection sensor detecting an empty state of the toner container, forecasts whether or not the waste toner container will be filled up with the waste toner before a toner container that has been newly loaded is emptied, based on the result of detection by the waste toner detection sensor, and a system control part that, upon the waste toner container full-state forecasting part forecasting that the waste toner container will be filled up, notifies a replacement message that urges replacement of the waste toner container to a panel part, wherein the waste toner container full-state forecasting part forecasts whether or not the waste toner container will be filled up with the waste toner at the point in time when at least one specified toner container is emptied, the plurality of toner containers accommodate a black toner and a plurality of color toners, respectively, and the waste toner container full-state forecasting part forecasts whether or not the waste toner container will be filled up with the waste toner at the point in time when the toner container of the plurality of toner containers with which the number of times that it was emptied is larger than a specific criterion value has been emptied.

6. The image forming apparatus according to claim 1, further comprising a plurality of the toner containers, wherein the waste toner container full-state forecasting part forecasts whether or not the waste toner container will be filled up with the waste toner at the point in time when any one of the plurality of toner containers has been emptied.

7. The image forming apparatus according to claim 1, wherein, the longer the replacement cycle time for the toner container that is an object the empty state of which is to be detected, the lower the waste toner container full-state forecasting part will set the accommodation rate for the waste toner container at which the waste toner container is determined to be in the state of being filled up.

8. The image forming apparatus according to claim 1, wherein the state in which the waste toner container is filled up is defined as a state in which the quantity of the waste toner in the waste toner container is equal to or over a specific accommodation quantity that does not exceed the capacity of the waste toner container.

9. The image forming apparatus according to claim 1, further comprising a waste toner accommodation part to which a waste toner container is detachably mounted, wherein the waste toner accommodation part is capable of being loaded with the toner container as a waste toner container.

* * * * *